US009783211B2

(12) United States Patent
Gibney et al.

(10) Patent No.: US 9,783,211 B2
(45) Date of Patent: Oct. 10, 2017

(54) COVERING SYSTEM FOR A HOPPER WAGON

(71) Applicant: Drax Power Limited, Selby, North Yorkshire (GB)

(72) Inventors: Richard Peter Gibney, Derby (GB); Stephen John Jones, Derby (GB); Jonathan James Barlow, Derby (GB)

(73) Assignee: Drax Power Limited, Selby, Yorkshire (GB)

( * ) Notice: Subject to any disclaimer, the term of this patent is extended or adjusted under 35 U.S.C. 154(b) by 89 days.

(21) Appl. No.: 14/768,648

(22) PCT Filed: Feb. 18, 2014

(86) PCT No.: PCT/GB2014/050473

§ 371 (c)(1),
(2) Date: Aug. 18, 2015

(87) PCT Pub. No.: WO2014/128451

PCT Pub. Date: Aug. 28, 2014

(65) Prior Publication Data

US 2015/0375761 A1 Dec. 31, 2015

(30) Foreign Application Priority Data

Feb. 19, 2013 (GB) ..... 1302876.6

(51) Int. Cl.
*B61D 39/00* (2006.01)
*B61D 7/00* (2006.01)

(52) U.S. Cl.
CPC ..... *B61D 39/001* (2013.01); *B61D 7/00* (2013.01)

(58) Field of Classification Search
CPC .... B61D 39/00; B61D 39/001; B61D 39/006; B61D 7/00
See application file for complete search history.

(56) References Cited

U.S. PATENT DOCUMENTS 2,408,132 A * 9/1946 Weeks ..... B60J 7/141 220/263
3,503,341 A * 3/1970 Widell ..... B61D 39/001 105/377.11

(Continued)

FOREIGN PATENT DOCUMENTS

CN 202703597 U 1/2013
WO 2014128451 A1 8/2014

OTHER PUBLICATIONS

International Search Report dated Jul. 10, 2014 in connection with related International Patent App. No. PCT/GB2014/050473, 5 pages.

(Continued)

*Primary Examiner* — Jason C Smith
(74) *Attorney, Agent, or Firm* — Gesmer Updegrove LLP

(57) ABSTRACT

The invention relates to a covering system for covering an inlet formed in a hopper wagon body of a hopper wagon, whereby the covering system comprises a cover that is configured to close the inlet when it is arranged in a closed position and open the inlet when it arranged in an open position and hinge means that is configured to mount the cover on the hopper wagon body such that the cover is hinged to an outer portion the hopper wagon body, adjacent the inlet and the cover is rotatable in a substantially vertical plane between the closed position and the open position. The hinge means may be configured to mount the cover in spaced relation above the inlet such that there is a gap space between the cover and the inlet when the cover is arranged in at least the closed position. The gap space may be formed between a hinged edge region of the cover and an adjacent edge of the inlet. The cover may comprise a single leaf door. The cover may comprise a double leaf door. The invention (Continued)

also relates to a hopper wagon comprising the covering system.

17 Claims, 10 Drawing Sheets

(56) References Cited

U.S. PATENT DOCUMENTS 4,077,329 A * 3/1978 Adler ..... B61D 39/00 105/248
4,821,648 A * 4/1989 Bramhall ..... B61D 39/001 105/377.08
5,542,734 A * 8/1996 Burchett ..... B60J 7/1621 105/377.06
6,402,224 B1 * 6/2002 Monaco ..... B60J 7/141 296/100.06
2006/0208526 A1 * 9/2006 Talbot ..... B60J 7/1621 296/100.07
2008/0236439 A1 * 10/2008 Low ..... B61D 17/12 105/377.05
2010/0037798 A1 * 2/2010 Schaefer ..... B61D 39/001 105/377.02
2011/0265684 A1 * 11/2011 Knight ..... B61D 39/001 105/377.06
2012/0048140 A1 * 3/2012 Dial ..... B61D 39/001 105/377.05
2012/0118195 A1 * 5/2012 Creighton ..... B61D 7/00 105/377.06
2013/0192488 A1 * 8/2013 Low ..... B61D 17/12 105/377.05
2014/0013994 A1 * 1/2014 Vande Sande ..... B61D 39/001 105/377.02
2015/0375761 A1 * 12/2015 Gibney ..... B61D 39/001 105/377.05
2016/0001787 A1 * 1/2016 Gibney ..... B61D 7/00 105/248
2016/0001792 A1 * 1/2016 Gibney ..... B61D 39/001 105/377.06

OTHER PUBLICATIONS

International Preliminary Report on Patentability dated Aug. 25, 2015 in connection with related International Patent App. No. PCT/GB2014/050473, 6 pages.

* cited by examiner

COVERING SYSTEM FOR A HOPPER WAGON

PRIORITY INFORMATION

The present invention is a continuation of PCT Application No. PCT/GB2014/050473 filed Feb. 18, 2014, that claims priority to GB Application No. 1302876.6, filed on Feb. 19, 2013, both of which are incorporated herein by reference in their entireties.

FIELD OF INVENTION

The present invention relates to covered hopper wagons. The present invention is particularly concerned with a covering system for covering an inlet of a hopper wagon.

BACKGROUND TO THE INVENTION

A hopper wagon is a type of freight railway vehicle for transporting bulk commodities. The bulk commodities are stored in a hopper wagon body. The hopper wagon body is supported by an underframe. Bogies may be coupled to the underside of the underframe to allow the hopper wagon to move along a railway.

The bulk commodities are loaded into the hopper wagon body through an inlet and discharged through an outlet. The inlet is an aperture that is conventionally formed in the top of the hopper wagon body whilst the outlet is an aperture that is conventionally formed in the bottom of the hopper wagon body. In covered hopper wagons, the inlet is provided with a covering system to protect the bulk commodities stored in the hopper wagon body.

In certain covered hopper wagons, the covering system may comprise a simple removable sheet. However, this type of covering system requires manual operation and the sheet must be stored when it is not in use. Other known covered hopper wagons have covering systems with one or more closable doors that open and close under a sliding or rotating action. Advantageously, the doors of these types of covering system remain attached to the hopper wagon body and may be driven to slide or rotate using automatic or semi-automatic drive means. However, covering systems with a slidable door require sufficient space to locate the door as it slides along a longitudinal axis of the hopper wagon to reveal the inlet aperture. Hence, the size of the inlet and/or spacing between adjacent hopper wagons is compromised. Covering systems with a clamshell door that pivots in an arcuate path around the hopper wagon body are difficult to control and are at risk of failing by opening unexpectedly under gravity. Covering systems with a door that rotates in a substantially vertical plane between an open position and closed position are conventionally designed such that the door is rotatably mounted by a hinge that is arranged internally, within the hopper wagon body. As a result, bulk commodities loaded in the hopper wagon body may interfere with the hinge and door, become compacted and ultimately inhibit the operation of the covering system. Moreover, due to the internal mounting arrangement of the hinge and door, rainfall may run off the door towards the hinge and into the hopper wagon body. Also, air flow apertures formed in the door may compromise the water tightness of the covering system.

Embodiments of the present invention seek to provide an alternative and improved covering system for a hopper wagon inlet. Embodiments of the present invention seek to address and ameliorate the problems associated with conventional covering systems.

SUMMARY OF THE INVENTION

The present invention is defined in the attached independent claims, to which reference should now be made. Further preferred features may be found in the sub-claims appended thereto.

A first aspect of the invention relates to a covering system for covering an inlet formed in a hopper wagon body.

The covering system comprises:

a cover for closing the inlet when it is arranged in a closed position and for opening the inlet when it is arranged in an open position;

hinge means for mounting the cover on the hopper wagon body, whereby in use the hinge means is arranged on one or more outer portions of the hopper wagon body such that the cover is hinged to an exterior of the hopper wagon body, adjacent the inlet and the cover is rotatable in a substantially vertical plane between the closed position and the open position.

The external mounting arrangement of the hinge means and cover advantageously separates the hinge means and cover from bulk commodities as they are loaded and stored in the hopper wagon body. As a result, the operation of the covering system is improved. Also, the external mounting arrangement advantageously guides rainfall and other elements falling on the door towards an outer surface of the hopper wagon body. As a result, the water tightness of the covering system is improved.

Preferably, the hinge means is configured to mount the cover in spaced relation above the inlet such that there is a gap space between the cover and the inlet, when the cover is arranged in at least the closed position. More specifically, the hinge means is configured to mount the cover with respect to the inlet such that there is a gap space between a hinged edge region of the cover and adjacent edge of the inlet.

The gap space may advantageously act as an air flow aperture between the cover and inlet. Preferably, the hinge means comprises multiple hinge brackets that are configured to be arranged intermittently on one or more outer portions of the hopper wagon body, adjacent the inlet, with a predetermined distance therebetween. The hinge brackets preferably form a hinge axis extending parallel with the inlet edge.

Preferably, the outer portion on which the hinge means is arranged is a cant rail of the hopper wagon body.

The cover may be a single leaf door. The hinge means may hinge a side edge of the door to an outer portion of a sidewall of the hopper wagon body such that the door extends longitudinally, adjacent the side edge of the inlet and at least the length of the inlet and the door is rotatable in a substantially vertical plane between the closed position and the open position.

When rotated to the closed position, the door is preferably configured to extend from the hinge means in a generally lateral direction across at least the length and width of the inlet.

When rotated to the open position, the door is preferably configured to extend from the hinge arrangement in a generally upright direction.

The hinge means may be configured to mount the door in spaced relation above the inlet such that there is a gap space between the hinged side edge of the door and the adjacent side edge of the inlet when the door is arranged in at least the closed position.

The cover may be a double leaf door comprising a first door and a second door. The hinge means may comprise first hinge means for mounting the first door to the hopper wagon body and second hinge means for mounting the second door to the hopper wagon body.

The first hinge means preferably hinges an outer (proximal) side edge of the first door to an outer portion of a first sidewall of the hopper wagon body such that the first door extends longitudinally, adjacent a first side edge of the inlet and at least the length of the inlet and the first door is rotatable in a substantially vertical plane between a closed position and an open position. Likewise the second hinge means preferably hinges an outer (proximal) side edge of the second door to an outer portion of a second sidewall of the hopper wagon body such that the second door panel extends longitudinally, adjacent the second side edge of the inlet and at least the length of the inlet and the second door is rotatable in a substantially vertical plane between a closed position and an open position.

The first hinge means may hinge the first door to a first cant rail. The second hinge means may hinge the second door to a second cant rail.

When both the first door and second door are rotated to the closed position, the first door and second door are configured to extend in a generally lateral direction across the inlet from the respective hinge means such that an inner (distal) edge of the first door and an inner (distal) edge of the second door engage and the inlet is thereby closed. The first door and second door may be configured to extend across the inlet from the respective hinge means at an incline relative to a horizontal plane such that the inner edges of the first door and second door engage at an apex. Hence, in the closed position, the first door and second door are configured to form a cover that has a cross-sectional profile of a triangle. The first door and second door may be inclined in the closing position so as to aid the flow of water off the first door and second door towards the exterior of the hopper wagon body. The first door and second door may be inclined in the closing position so as to optimise the storage capacity of the hopper wagon body and conform to the peaked shaped load of bulk commodities.

When rotated in the open position, the first door and second door are configured to extend in a generally upright direction from the respective hinge means such that the inlet is uncovered.

The first hinge means may be configured to mount the first door in spaced relation above the inlet such that there is a gap space between the hinged first side edge of the first door and the adjacent first side edge of the inlet when the first door is arranged in at least the closed position. Additionally or alternatively, the second hinge may be configured to mount the second door in spaced relation above the inlet such that there is a gap spaced between the hinged second side edge of the second door and the adjacent second side edge of the inlet when the second door is arranged in at least the closed position.

The covering system may comprise sealing means. The sealing means are preferably configured to provide a sealing engagement between the respective inner edges of the first door and second door. The sealing engagement enhances the water tightness of the covering system.

The covering system may comprise drive means to rotate the cover between the open position and the closed position. If the cover comprises a first door and a second door then the drive means may comprise a first actuator for rotating the first door between the open position and closed position and a second actuator for rotating the second door between the open position and the closed position. The drive means may be configured to simultaneously or sequentially rotate the first door and second door between the open position and closed position.

A second aspect of the invention relates to a hopper wagon comprising:

- a hopper wagon body for storing bulk commodities therein;
- an inlet through which bulk commodities can be loaded into the hopper wagon;
- a covering system for covering the inlet aperture, whereby the covering system comprises a cover that closes the inlet when it is arranged in a closed position and opens the inlet when it is arranged in an open position and hinge means that mount the cover on the hopper wagon body such that the cover is hinged to an exterior of the hopper wagon body, adjacent the inlet and the cover is rotatable in a substantially vertical plane between the closed position and the open position.

BRIEF DESCRIPTION OF DRAWINGS

For a better understanding of the present invention and to show how it may be carried into effect, reference shall now be made by way of example to the accompanying drawings in which.

DETAILED DESCRIPTION OF THE INVENTION

Figure 1:
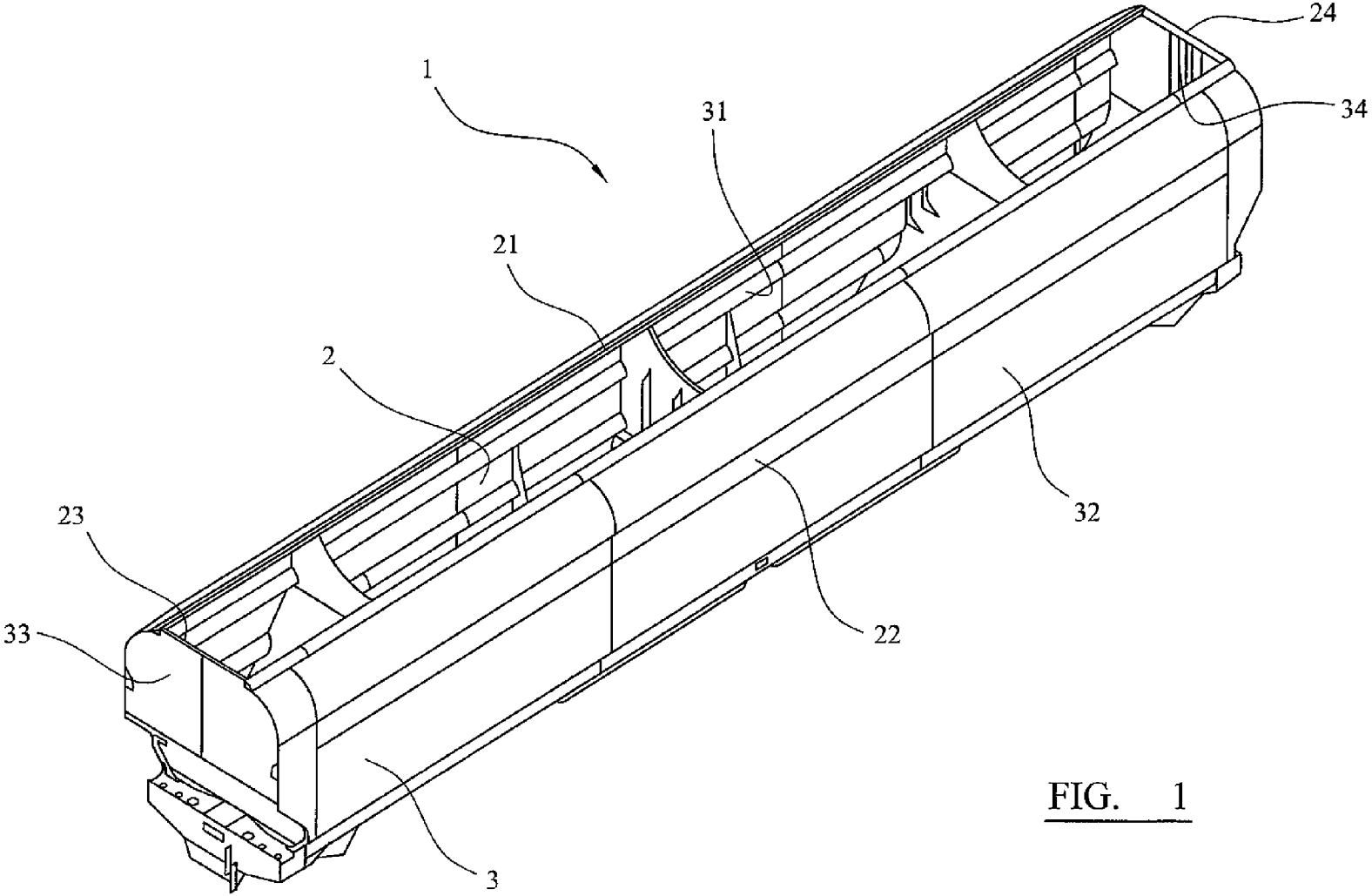
FIG. 1 depicts a perspective view of an embodiment of a covered hopper wagon according to the present invention, without the covering system mounted in situ.

The covering system according to the present invention is a gate-like or barrier mechanism for opening and closing an inlet formed in the hopper wagon body of a hopper wagon. As a result, the covering system is able to control access into the hopper wagon via the inlet.

The covering system comprises a closable cover for covering the inlet.

When the cover is arranged in a closed position, the cover is configured to extend across the length and width of the inlet such that the inlet is at least substantially covered (shut, obstructed). As a result, access into the hopper wagon body via the inlet is at least substantially restricted. Any bulk commodities stored within the hopper wagon body are at least substantially concealed (enclosed) within the hopper wagon.

When the cover is arranged in the open position, the cover is configured to extend from the hinge means in a direction away from the inlet such that the inlet of the hopper wagon is at least substantially open (unrestricted, exposed). As a result, the inlet is sufficiently uncovered to allow for the loading of bulk commodities into the hopper wagon body through the inlet. For example, the inlet may be sufficiently open to receive a chute that directs bulk commodities into the hopper wagon body.

In the transition period whilst the cover is rotating between the closed position and the open position, the inlet is partially closed/open.

The cover of the covering system may be used to close the inlet so as to help protect bulk commodities stored within the hopper wagon from the external environment, e.g. from undesirable weather conditions. The cover of the covering system may be used to close the inlet so as to help prevent bulk commodities from escaping from the hopper wagon body, e.g. during transportation. The cover of the covering system may be used to close the inlet so as to help maintain or achieve certain transportation conditions within the hopper wagon body, e.g. certain temperature, pressure and/or moisture levels. The cover of the covering system may be used to open the inlet so as to allow for the loading of bulk commodities into the hopper wagon body via the inlet. The cover of the covering system may be used to define a chute, help guide a chute apparatus and/or bulk commodities towards the inlet.

The covering system further comprises hinge means for mounting the cover on the hopper wagon body, adjacent the inlet.

The hinge means is configured to be arranged (located) on one or more outer portions of the hopper wagon body adjacent the inlet such that the cover is hinged to the exterior of the hopper wagon body, alongside the inlet. The axis of the hinge means extends parallel to the edge of the inlet. The hinge means may be coupled to any suitable external or outwardly facing component part(s) or surface(s) of the hopper wagon body. For example, the hinge means may be coupled to one or more supporting or structural members of the hopper wagon body, such as a cant rail. Due to the external mounting arrangement of the hinge means and cover, the hinge means and the cover are isolated (set apart) from the bulk commodities as they are loaded and stored in the hopper wagon body. As a result, the risk of bulk commodities collecting around and interfering with the hinge means and/or hinged region of the cover during the loading and storage of the bulk commodities is thereby reduced, preferably minimised. Hence, the external mounting design improves the efficacy and operational lifespan of the covering system. Moreover, whether the cover is open or closed, rainfall and/or elements (e.g. debris) falling on an outer surface of the cover will be guided to flow towards the exterior of the hopper wagon body rather than towards the inlet. Thus, the external mounting design improves the water tightness of the covering system.

The hinge means is also configured to pivotally mount the cover on the hopper wagon body such that the cover can be rotated in a vertical plane between the closed position and the open position relative to the inlet.

The cover is preferably configured to be rotated between the closed position and the open position by drive means. The drive means may be manually operable, automatic and/or semi-automatic. The drive means may be mounted on the hopper wagon body and coupled to the cover.

The hinge means is preferably configured to mount the cover on the hopper wagon body such that the cover is arranged in spaced relation above the inlet. As a result, a gap space is formed between the cover and the inlet aperture. In a preferred embodiment, the hinge means is configured to mount the cover on the hopper wagon body such that at least a portion of a hinged edge region of the cover is arranged in spaced relation above at least a portion of the adjacent peripheral edge of the inlet. Hence, a gap space is formed between a hinged edge region of the cover and adjacent peripheral edge region of the inlet.

So as to restrict the ingress of water through the gap space between the cover and inlet, and thereby at least substantially retain the water tightness of the covering system, a portion of the cover is preferably configured to overhang or extend beyond the adjacent peripheral edge of the inlet. The portion may be a planar member extending from the hinged edge region of the cover. The hinge means is preferably configured to mount the cover such that there is a gap space between the hinged edge region of the cover and adjacent peripheral edge of the inlet when the cover is arranged in the closed position relative to the inlet. The hinge means may also be configured to mount the cover such that further gap spaces are formed between one or more non-hinged edge regions of the cover and the adjacent peripheral edge regions of the inlet when the cover is arranged in the closed position. The one or more gap spaces between the cover and the inlet advantageously act as an air flow aperture that allows air to flow into the hopper wagon body and thereby inhibits the formation of a vacuum during the discharging of bulk commodities through an outlet in the bottom of the hopper wagon body. Hence, the covering system of the present invention aids the discharging process of the bulk commodities and avoids undesirable loads.

The hinge means may be configured to mount the cover such that there is a gap space between the hinged edge region of the cover and adjacent peripheral edge region of the inlet when the cover is arranged in an open position. This advantageously allows air to flow out of the hopper wagon body and may help to limit the build of air pressure during the loading of the bulk commodities through the inlet aperture. Hence, the covering system aids the loading process of the bulk commodities.

The hinge means may be configured to mount the cover such that there is a gap space between the hinged edge region of the cover and adjacent peripheral edge region of the inlet during a transition period as the cover is rotated between the closed and open positions. Hence, air may flow into or out of the hopper wagon so as to regulate the air pressure within the hopper wagon body.

The gap space between the cover and inlet may vary in size depending on the position of the cover. The gap space may fall within the range of approximately 3 mm to 7 mm when the cover is closed. The gap space may fall within the range of approximately 10 mm to 40 mm when the cover is open.

The hinge means may comprise a plurality of hinge devices arranged intermittently and/or longitudinally along an outer surface of the hopper wagon body, adjacent the inlet. The hinge devices may be hinge brackets. The hinge devices may be spaced apart on the exterior of the hopper wagon body by a predetermined distance. For example, the hinge devices may be longitudinally separated by a distance falling within the range of approximately 70 cm to 150 cm.

In an embodiment of the covering system, the cover may be a single leaf door and the hinge means may be configured to hinge an edge of the door to an outer portion of the hopper wagon body, adjacent an edge of the inlet. For example, the hinge means may be configured to hinge a side edge of the door to an exterior portion of the sidewall of the hopper wagon body, adjacent a side edge of an inlet. As a result, the door extends longitudinally at least the length of the inlet and the hinged side edge of the door extends at least substantially parallel to the adjacent side edge of the inlet. The hinge means is configured to provide a horizontal axis that extends parallel to the adjacent side edge of the inlet. The hinge means is also configured to hinge the door such that the door is rotatable in a vertical plane between a closed position and an open position relative to the inlet. When rotated to the closed position, the door is configured to extend from the hinge means in a generally horizontal plane across the length and width of the inlet aperture. As a result, the door forms a covering that closes/screens-off the inlet. When rotated to the open position, the door is configured to extend in a generally upright direction from the hinge means such that the inlet aperture is sufficiently exposed to allow for the loading of bulk commodities. The hinge means is preferably configured to mount the door in spaced relation to the inlet such that an air gap space is formed between the hinged side edge of the door and adjacent side edge of the inlet when the door is arranged in at least the closed position. Preferably, a portion of the door is configured to overhang the air gap space.

In an alternative embodiment of the covering system, the cover may be a double leaf door comprising a first door and a second door. The hinge means may comprise a first hinge means for externally and rotationally mounting the first door on the hopper wagon body and a second hinge means for externally and rotationally mounting the second door on the hopper wagon body. As a result, the first door is coupled to an exterior portion of the hopper wagon body, alongside a first edge of the inlet and is rotatable in a vertical plane between a closed position and an open position. Likewise, the second door is coupled to an exterior portion of the hopper wagon body, alongside a second edge of the inlet and is rotatable in a vertical plane between a closed position and an open position. When rotated to the closed position, the first door and second door engage and thereby form a covering that shrouds the inlet. Depending on the configuration of double leaf door, the first door and second may engage along an axis that is parallel to the longitudinal axis of the inlet or along an axis that is transverse to the longitudinal axis of the inlet. When rotated to the closed position, the first door and second door may be configured to extend in a generally horizontal plane from the respective hinge means such that they engage and form a covering with a substantially planar cross-sectional profile. Alternatively, the first door and second door may be arranged to extend from the respective hinge means at an incline relative to a horizontal plane and engage at an apex, forming a covering with a triangular cross-sectional profile. The incline angle of the doors may fall within the range of approximately 10° to 50°. To optimise fluid run off and keep the doors within railway loading gauge, the incline angle may fall within the range of approximately 15° to 45°. When rotated to an open position the first door and second door are configured to extend from the respective hinge means in a generally upright direction such that the inlet aperture is sufficiently exposed to allow for the loading of bulk commodities. The first hinge means may be configured to mount the first door in spaced relation to the inlet such that an air gap space is formed between the hinged edge region of the first door and adjacent edge region of the inlet when the first door is arranged in at least the closed position. Additionally or alternatively, the second hinge means may be configured to mount the second door in spaced relation to the inlet such that an air gap space is formed between the hinged edge region of the second door and adjacent edge region of the inlet when the second door is arranged in at least the closed position. Preferably, a portion of the first door and/or a portion of the second door is configured to overhang the respective gap space.

FIGS. 1 to 5 relate to an embodiment of a covered hopper wagon according to the present invention.

As illustrated in FIGS. 1 to 5, the covered hopper wagon (1) comprises an inlet (2) formed in the top of a hopper wagon body (3). The inlet has a generally rectangular shape with a first side edge (21), a second side edge (22), a first end edge (23) and a second end edge (24). In this embodiment, the inlet extends the length of the hopper wagon body and it is defined by a first sidewall (31), a second sidewall (32), a first end wall (33) and a second end wall (34) of the hopper wagon body. A first cant rail (4*a*) extends externally along the first sidewall, adjacent and parallel to the first side edge. A second cant rail (4*b*) extends externally along the exterior of the second sidewall, adjacent and parallel to the second sidewall. The cant rails help to improve the structural integrity of the hopper wagon body.

The covered hopper wagon comprises a covering system (10) for covering the inlet. In embodiment depicted in FIGS. 1 to 5, the covering system has a closable double leaf door for covering the inlet and hinge means for hinging the door leaves to the hopper wagon body.

The double leaf door comprises a first door (11*a*) and a second door (11*b*). Each door has a generally rectangular shaped body with an outer (proximal) side edge, inner (distal) side edge, first end edge and second end edge.

The hinge means comprises first hinge means (12*a*) and second hinge means (12*b*).

The first hinge means is configured to mount the first door on the hopper wagon body such that an outer side edge of the first door (11*a*OUT) is hinged to the first cant rail, alongside the first side edge of the inlet and the first door is rotatable in a vertical plane, about a horizontal axis between a closed position and an open position. Likewise, the second hinge means is configured to mount the second door on the hopper wagon body such that an outer side edge of the second door (11*b*OUT) is hinged to the exterior of the second sidewall of the hopper wagon body, alongside the second side edge of the inlet and the second door is rotatable in a vertical plane, about a horizontal axis, between a closed position and open position.

The first hinge means comprises a plurality of hinge brackets (121) that are intermittently disposed along the first cant rail of the hopper wagon body. The second hinge means comprises a plurality of hinge brackets (121) that are intermittently disposed along the second cant rail of the hopper wagon body. In this embodiment, the hinge brackets are spaced apart along the cant rails by a distance of approximately 1265 mm.

The exterior arrangement of the hinge brackets, first door and second door advantageously spaces them from bulk material being loaded via the inlet and stored within the hopper wagon body. Hence, operational problems caused by bulk commodities interfering with the hinge brackets, first door and second door are reduced, preferably minimised. Moreover, rain and/or other elements falling on the closed doors are guided towards the exterior of the hopper wagon body.

When the first door and second door are both rotated to a closed position, the first door and second door extend from the respective hinge means at an incline relative to the horizontal plane and engage at an apex (13) that extends along a longitudinal axis (ZZ). Hence, the first door and second door form a covering that extends across the length and width of the inlet and thereby shrouds the inlet. As illustrated in FIGS. 2*a* to 2*d*, the closed first door and closed second door form a covering with a cross-sectional profile of a triangle. This cross-sectional profile aids the flow of water etc. off the first door and second door towards the exterior of the hopper wagon body. The triangular cross-sectional profile improves the loading capacity of the hopper wagon. Moreover, given that the bulk commodities typically form a peak shaped load within the hopper wagon body, the triangular cross-sectional profile of the doors advantageously conforms with the shape of the bulk commodities and the inner surfaces of the doors preferably avoid contact with the bulk commodities.

As shown in FIGS. 2*a* to 3*c*, the first door and the second door further comprise end sections (11*a*END, 11*b*END) extending downwardly from the first and second end edges of the rectangular body of the doors. The end sections may have any suitable configuration and purpose. In this embodiment of the invention, the end sections of the first door and second door are configured so as to incline the doors at a predetermined angle and thereby achieve a cover with a desirable triangular cross-sectional profile when the first door and second door are arranged in the closed position. The end sections may be deformable to help achieve a sealing effect between the end edges of the doors and end walls of the hopper wagon body. The end sections may be removably attachable to the rectangular body of the doors.

In an alternative embodiment, the first door and second door may be arranged to extend in generally horizontal direction from the respective sidewalls of the hopper body such that they meet at a joint and form a covering with a substantially planar cross-sectional profile.

The covering system comprises sealing means so as to aid, preferably optimise, the sealing engagement of the inner edges of the closed doors (11*a*IN, 11*b*IN). The sealing means may comprise any suitable sealing means arranged along the inner edge regions of the doors. In the embodiment depicted, the sealing means comprises a resiliently deformable flap (14) that is arranged at least substantially along the length of the inner edge of the first door. When the first door and second door are arranged in the closed position, the flap extends across and abuts the second door, thereby forming a seal.

Figure 3A:
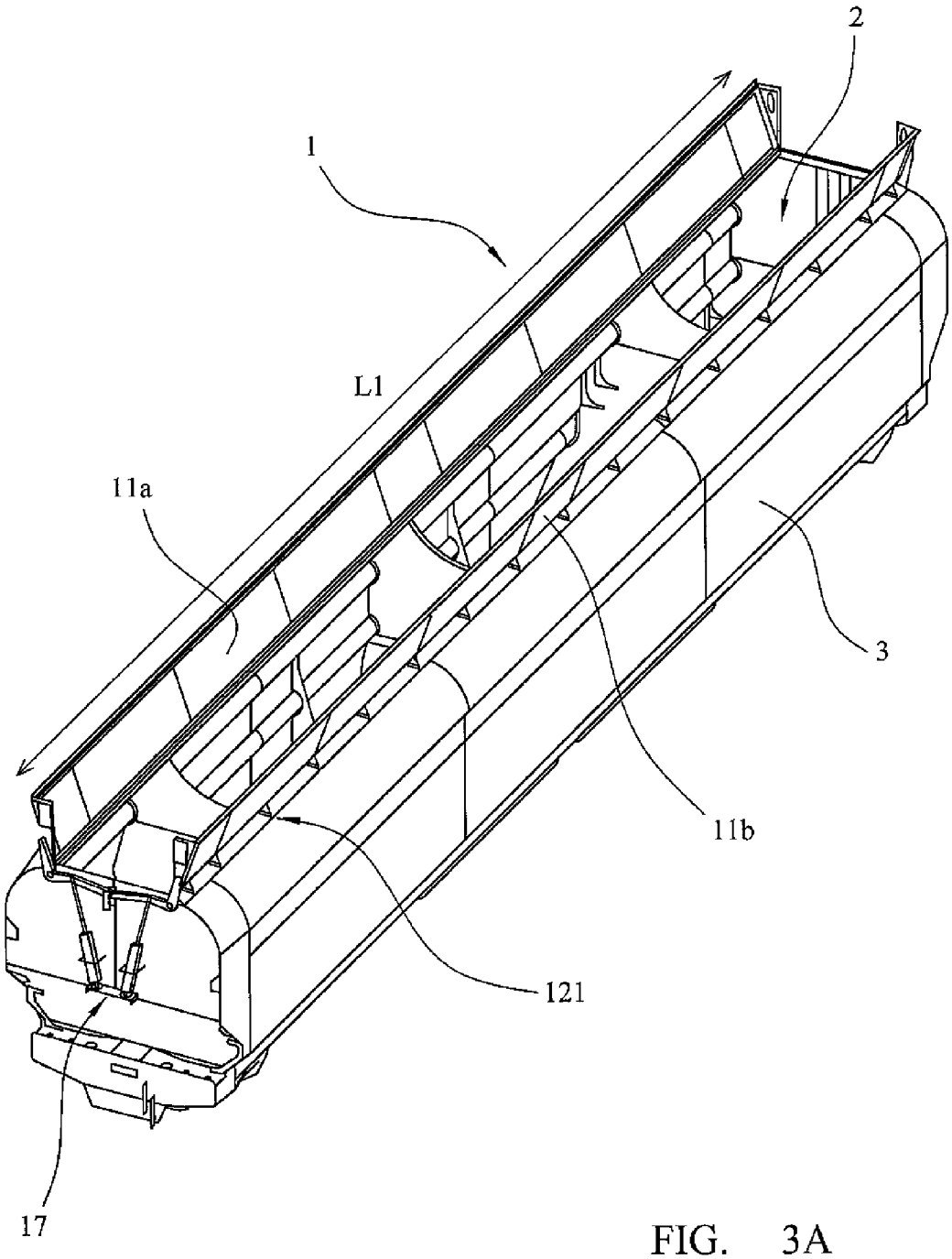
FIG. 3*a* depicts a perspective view of the embodiment of the covered hopper wagon, where the cover of the covering system is arranged in an open position over the inlet.
Figure 3B:
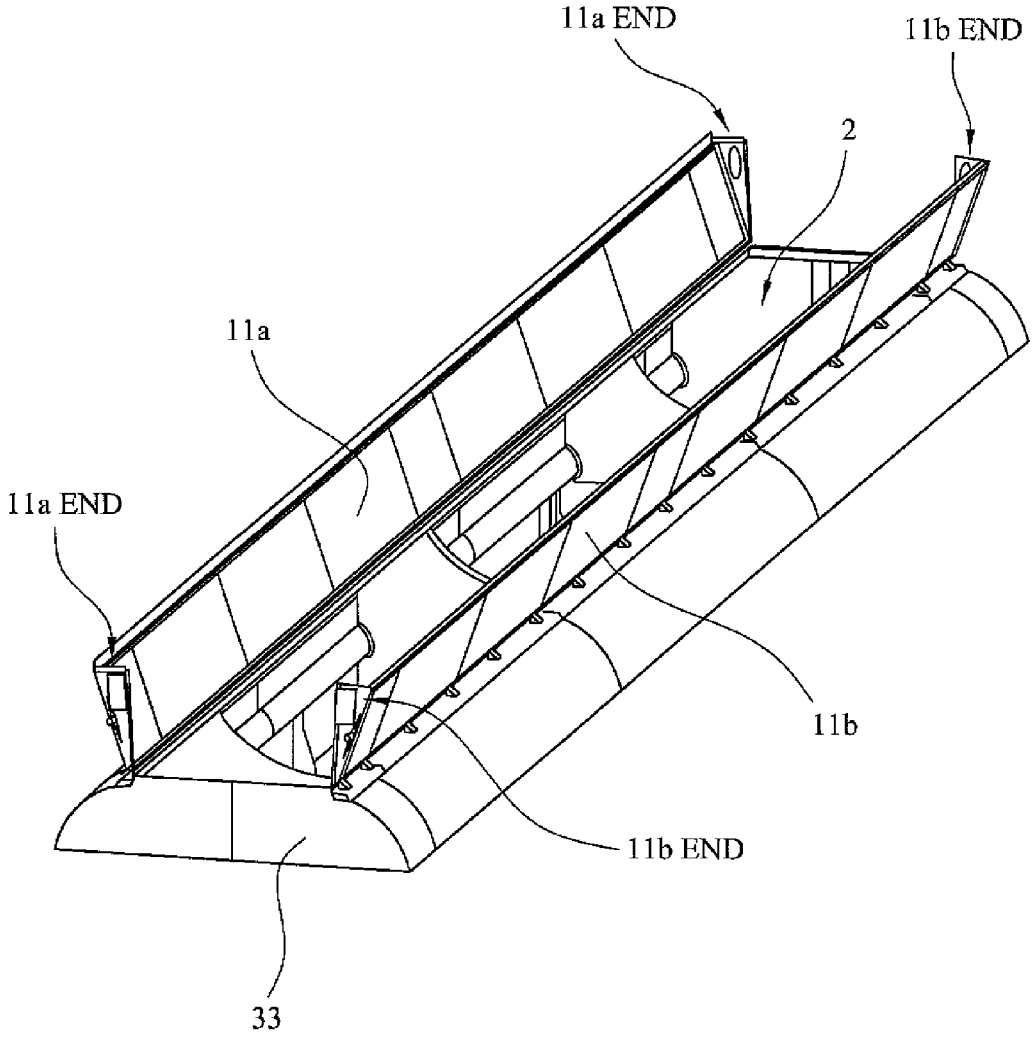
FIG. 3*b* depicts a perspective view of the upper portion of the covered hopper wagon as shown in FIG. 3*a;*
Figure 3C:
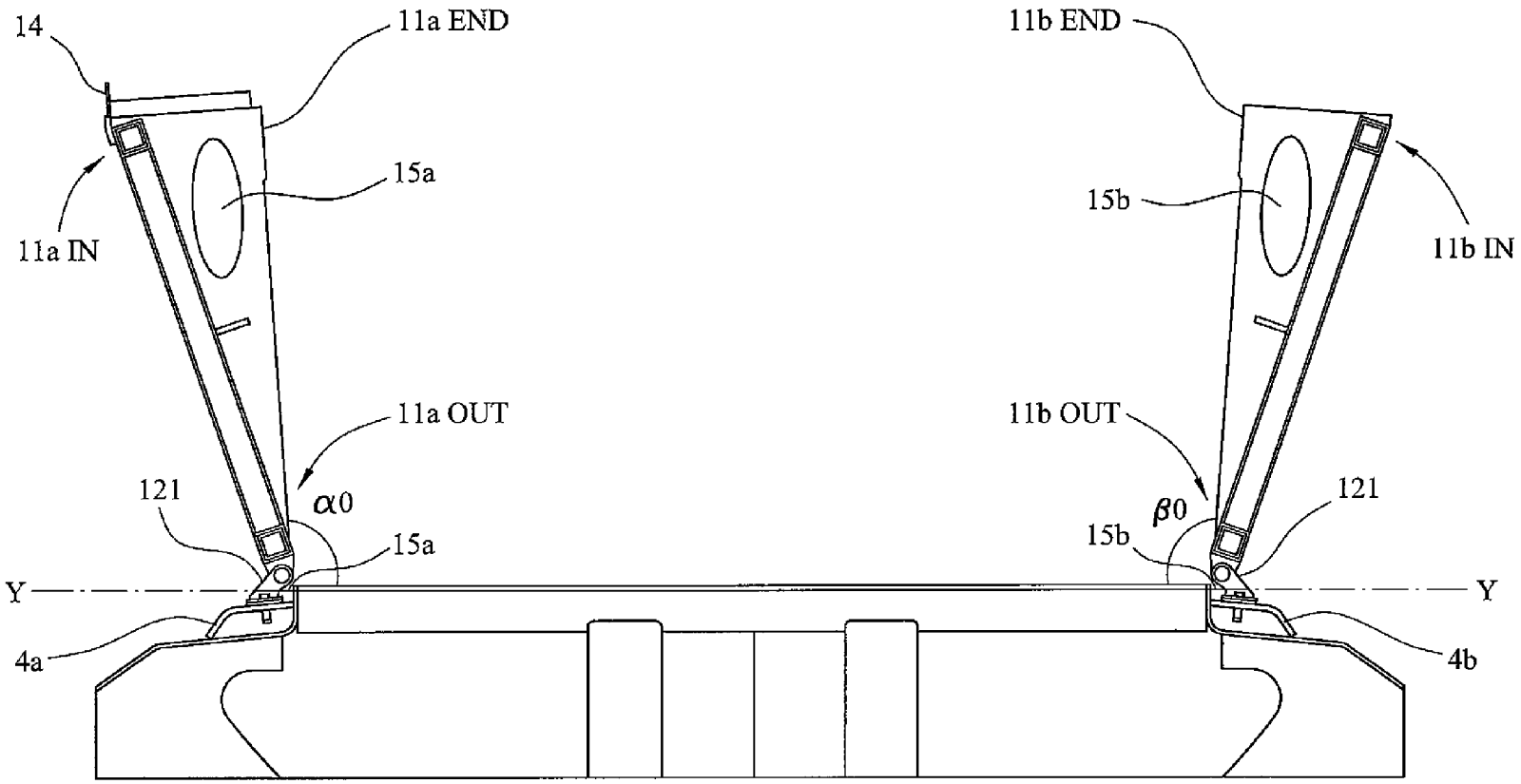
FIG. 3*c* depicts an end view of the upper portion of the covered hopper wagon as shown in FIG. 3*a;*

In the open position, the first door and second door may be rotated to extend from the sidewalls in a generally upright direction. The first door and second door may extend parallel to a vertical axis as shown in FIGS. 3*a* to 3*c*. Alternatively, the first door member and second door member may be rotated to extend beyond the vertical plane such that the first door and second door is orientated to extend upwardly in a direction away from the hopper wagon body and inlet. As a result, the doors lie with their centres of gravity slightly beyond the hinge brackets. The doors are said to be "over-centre" and, as a result, they remain in the open position by gravity. In the open position, the first door and second door are rotated such that the inlet is sufficiently accessible to allow for the loading of bulk commodities through the inlet.

In the embodiment depicted in FIGS. 1 to 5, the inlet of the hopper wagon has a side edge of approximately 17.9 m and an end edge of approximately 151 cm. The first door has a length L1 of approximately 18.3 m and width W1 of approximately 82 cm. The second door has a length L2 of approximately 18.3 m and width W2 of approximately 82 cm. In the closed position, the first door is arranged at an incline angle $\alpha C$ of approximately 15° relative to a horizontal plane YY. Likewise, the second door member is arranged at an incline angle of $\beta C$ of approximately 15°. In the open position, the first door is arranged in an open position at angle $\alpha O$ approximately 114° relative to the horizontal plane YY. Likewise, the second door is arranged in an open position ay angle $\beta O$ of approximately 114°.

The first hinge means mounts the first door in spaced relation above the inlet such that there is a gap space (15*a*) between the outer edge of the first door (11*a*OUT) and the first peripheral side edge (21) of the inlet aperture. The gap space acts as a first air flow aperture. In this embodiment, the gap space between the outer edge of the first door and the first peripheral side edge of the inlet is approximately 3 mm when the first door is in the closed position and is approximately 30 mm when the first door is in the open position.

Figure 4:
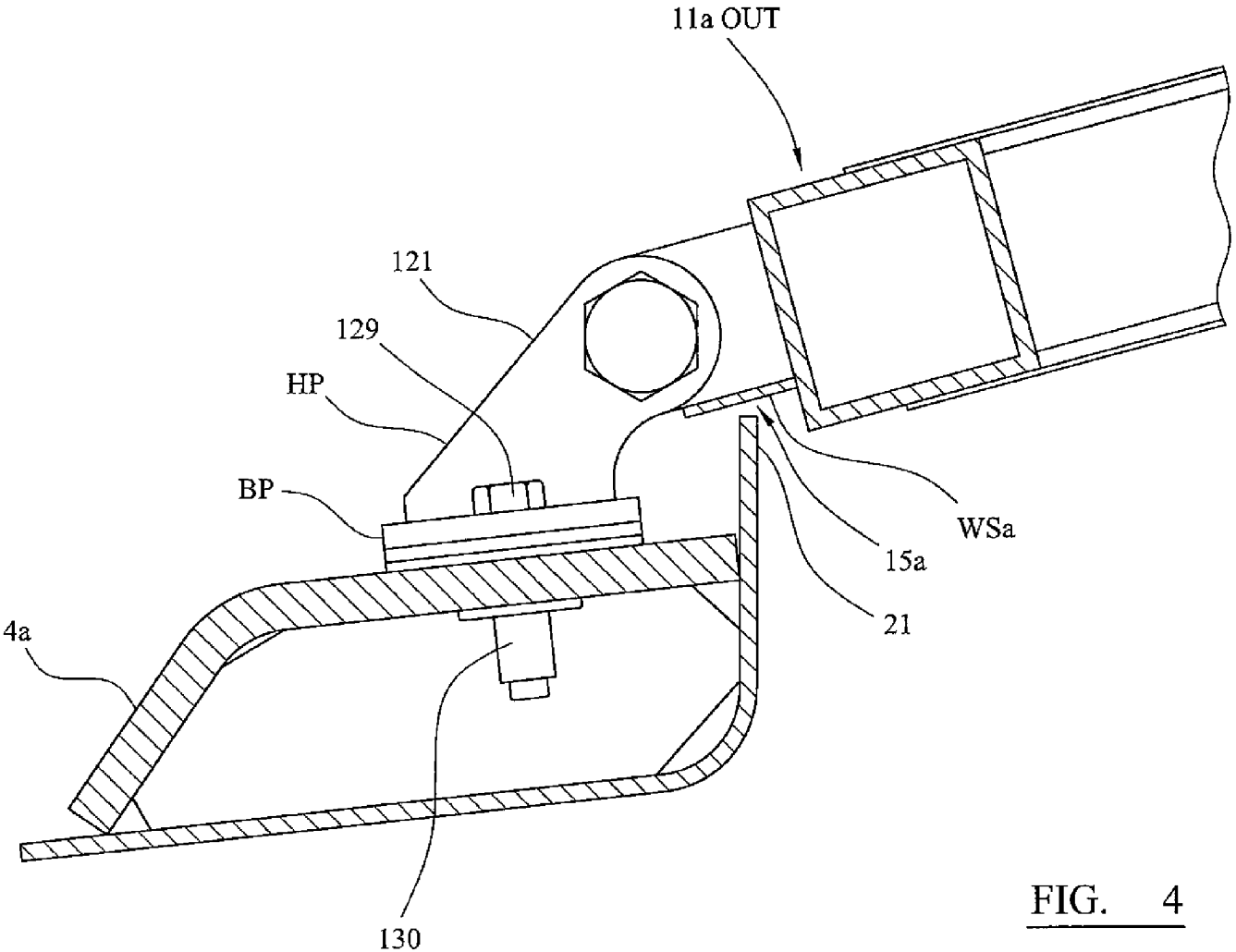
FIG. 4 depicts a partial cross-sectional view of the embodiment of the covered hopper wagon, showing how a hinge bracket rotationally mounts a door of the cover on a cant rail of the hopper wagon body.

As can be seen in FIG. 4, a first weather strip (WSa) extends from the outer edge of the first door (11*a*OUT) and beyond the gap space (15*a*) (for example, by approximately 25 mm) so as to minimise the ingress of water into the gap space.

The second hinge means mounts the second door in spaced relation above the inlet such that there is a gap space (15*b*) between the outer edge of the second door (11*b*OUT) and the second peripheral side edge (22) of the inlet aperture. The gap space acts as a second air flow aperture and a second bulk commodities overflow aperture as necessary. The gap space between the outer edge of the second door and the second peripheral side edge of the inlet is approximately 3 mm when the second door is in a closed position and is approximately 300 mm when the second door is in the open position.

A second weather strip (not shown) extends from the outer edge of the second door (11*b*OUT) and beyond the gap space (15*b*) (for example, by approximately 25 mm) so as to minimise the ingress of water into the gap space.

The first and second weather strips preferably extend at least substantially along the length of the outer edge of the first door. The weather strip may be formed from aluminium and may be welded or riveted to the outer edge of the first door.

Figure 5:
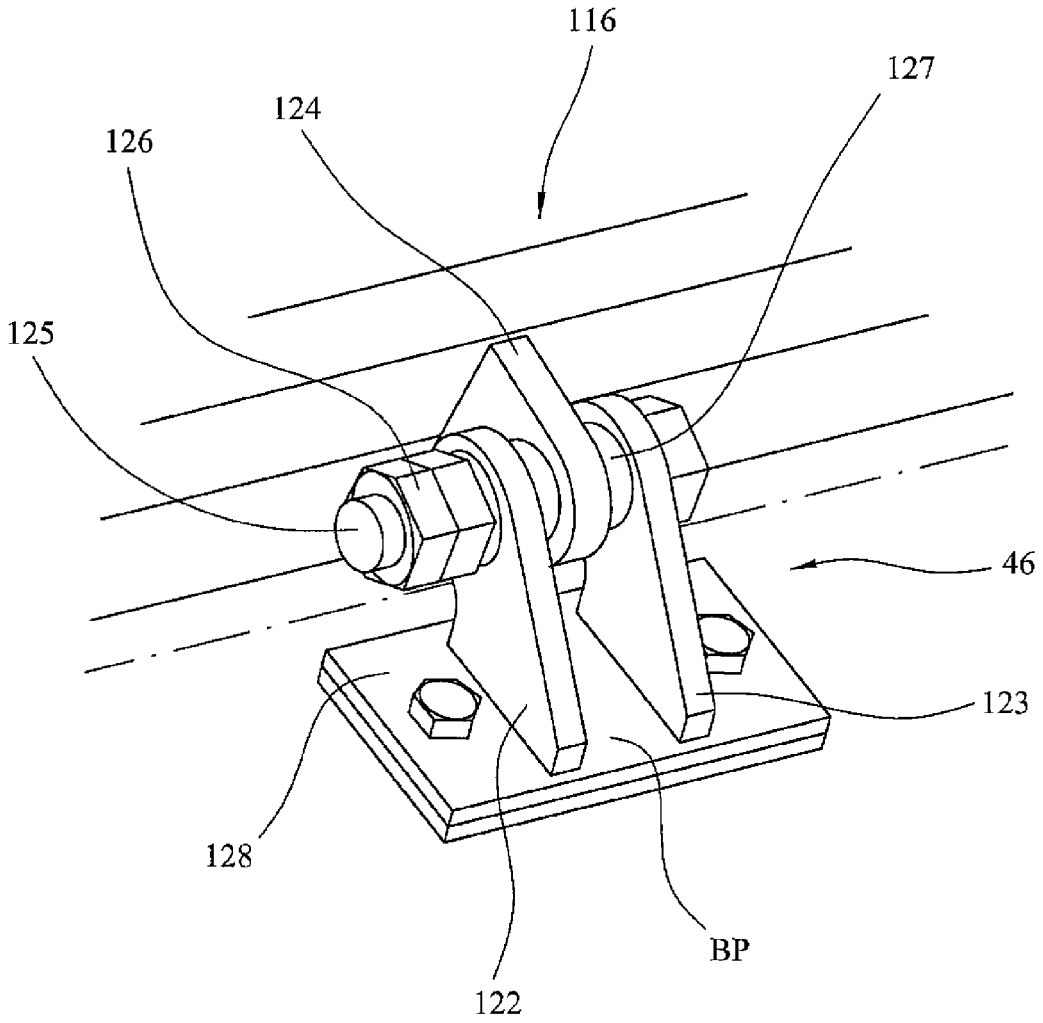
FIG. 5 depicts a top view of the hinge bracket as shown in FIG. 4.

As can be seen in FIGS. 4 and 5, the hinge brackets of the first hinge means and second hinge means comprise a hinge portion (HP) for rotationally coupling a door and a bracket portion (BP) for coupling the hinge bracket to the corresponding cant rail. The hinge portion (HP) comprises a first hinge finger (122) and a second hinge finger (123). The hinge fingers protrude upwardly from the bracket portion and are configured to receive a corresponding rotatable finger (124) of the door therebetween. When apertures formed in the upper portion of the first hinge finger, upper portion of the second hinge finger and lower portion of the rotatable finger are aligned, a hinge rod (125) is configured to extend therethrough so as to rotationally couple the door to the hinge bracket. The hinge rod is secured by nuts (126), washers (127) or any other suitable means so as to maintain the arrangement. The bracket portion comprises a foot (128)

that is configured to be secured to the cant rail using nuts (129) and bolts (130) or any other suitable means.

To further improve the air flow into and out of the hopper wagon body, the end sections of the first door and second door may comprise air flow apertures (15*a*, 15*b*). The air flow apertures are preferably shielded by overhanging cowls (16*a*, 16*b*) as shown in FIGS. 2*a*-3*c* so as to restrict the ingress of water.

Figure 2A:
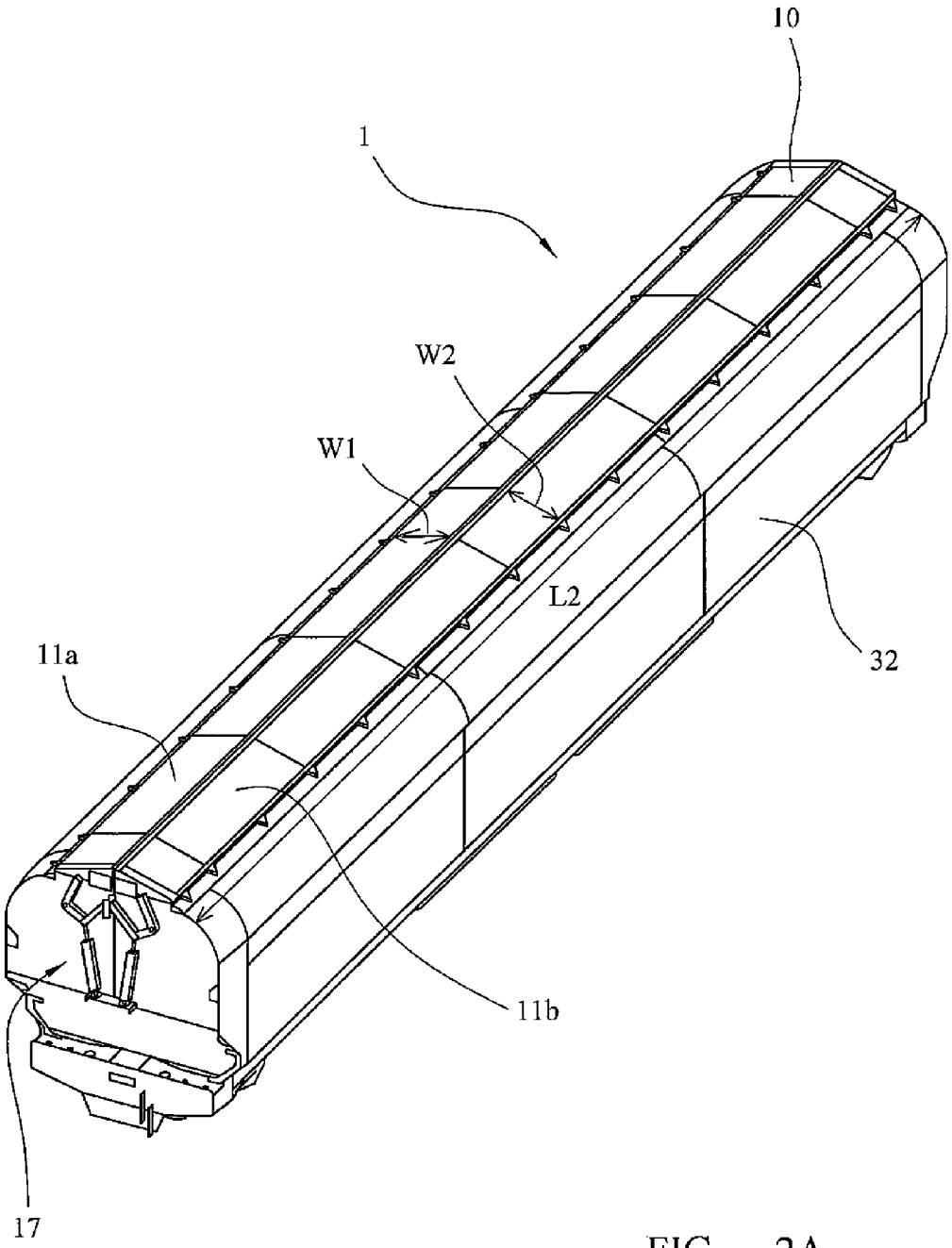
FIG. 2*a* depicts a perspective view of the embodiment of a covered hopper wagon according to the present invention, where the cover of the covering system is arranged in a closed position over the inlet.
Figure 2B:
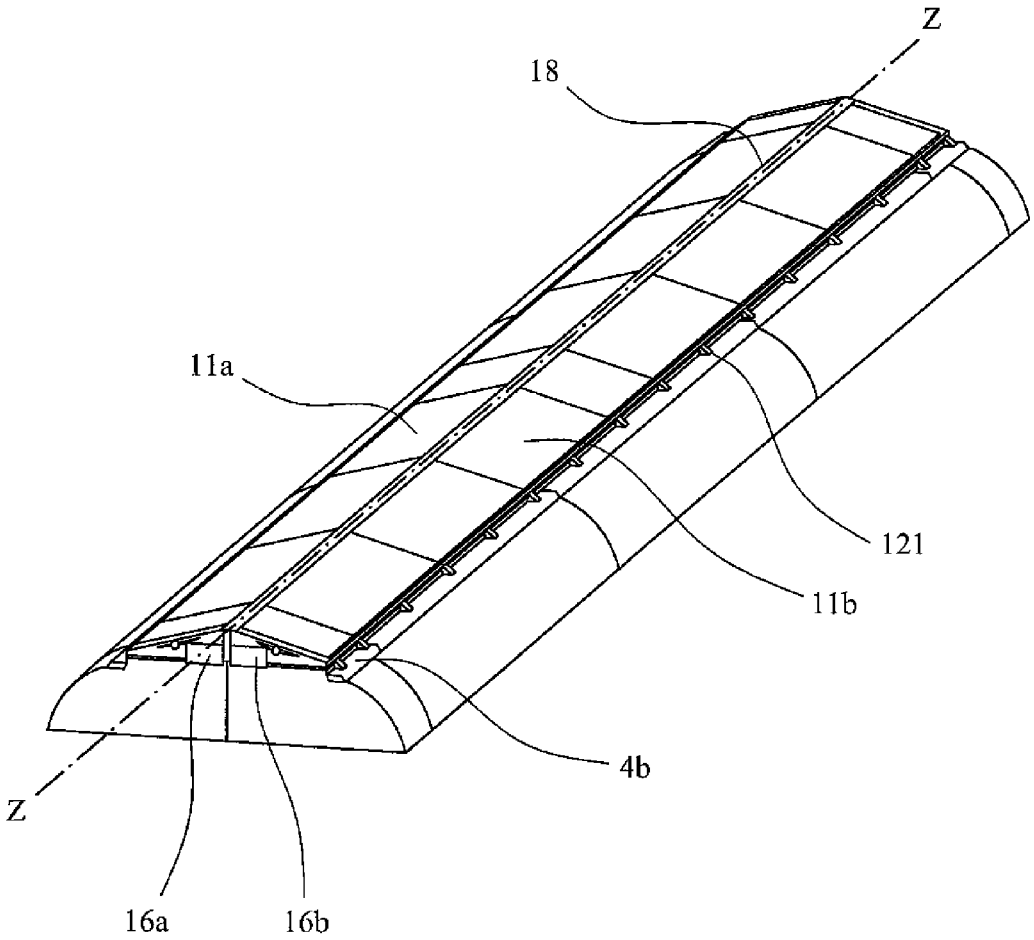
FIG. 2*b* depicts a perspective view of the upper portion of the covered hopper wagon as shown in FIG. 2*a;*
Figure 2C:
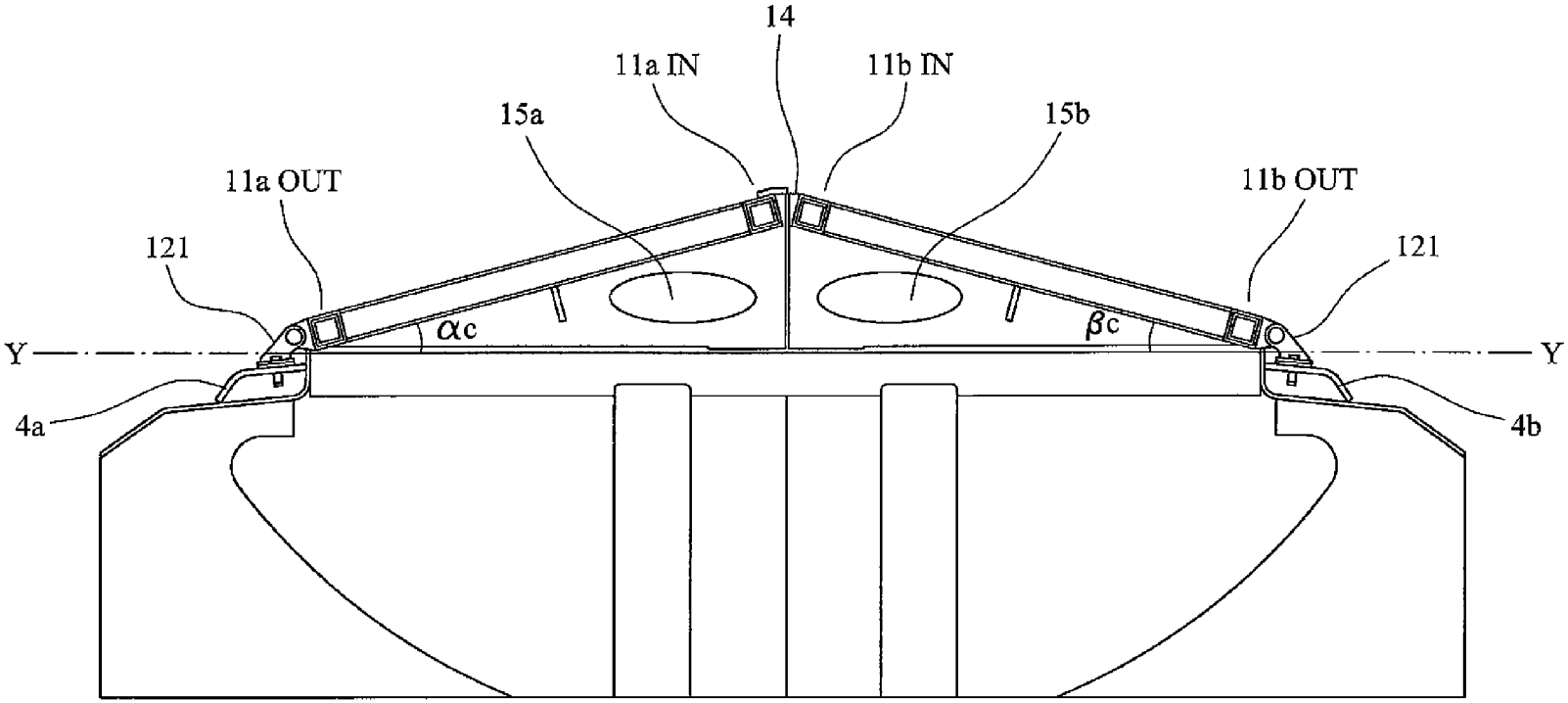
FIG. 2*c* depicts an end view of the upper portion of the covered hopper wagon as shown in FIG. 2*a;*
Figure 2D:
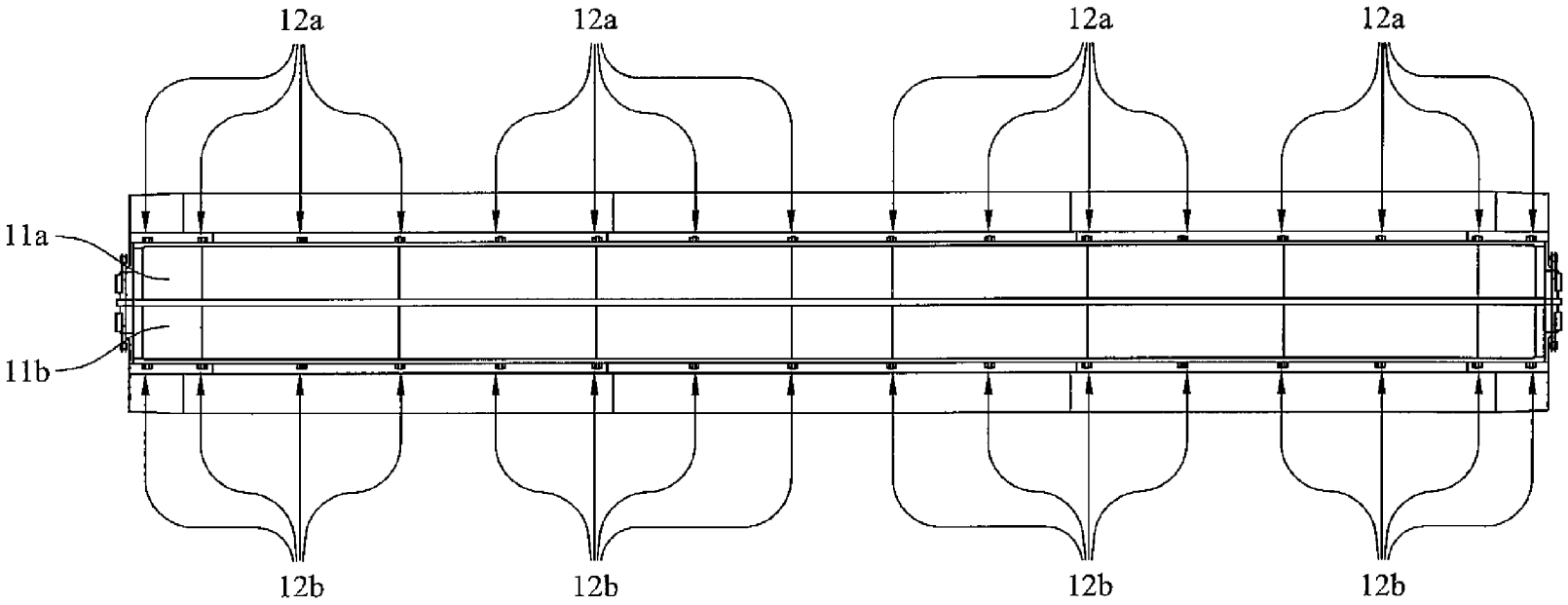
FIG. 2*d* depicts a top view of the covered hopper wagon as shown in FIG. 2.

This embodiment of the covering system comprises drive means (17) to automatically drive the first door and second door between the closed position and the open position. Due to the configuration of the sealing flap (14), the drive means sequentially drive the first door and second door between the closed position and the open position so as to ensure the first door is closed last and the first door is opened first. As shown in FIGS. 2*a* and 3*a* the drive means are arranged on the end walls of the hopper wagon and coupled to the end sections of the respective first door and second door.

Whilst endeavouring in the foregoing specification to draw attention to those features of the invention believed to be of particular importance, it should be understood that the Applicant claims protection in respect of a patentable feature or combination of features referred to herein, and/or shown in the Figures, whether or not particular emphasis has been placed thereon.

Throughout the description and claims of this specification, the words "comprise" and "contain", and any variations of the words, means "including but not limited to" and is not intended to (and does not) exclude other features, elements, components, integers or steps.

Throughout the description and claims of this specification, the singular encompasses the plural unless the context requires otherwise. In particular, where the indefinite article is used, the specification is to be understood as contemplating plurality as well as singularity, unless the context requires otherwise.

Features, integers or characteristics described in conjunction with a particular aspect, embodiment or example of the invention are to be understood to be applicable to any other aspect, embodiment or example described herein unless incompatible therewith.

The invention claimed is:

1. A covering system for covering an inlet of a hopper wagon body, the covering system comprising:

a cover for closing the inlet when it is arranged in a closed position and for opening the inlet when it is arranged in an open position, a hinge for mounting the cover on the hopper wagon, the hinge being arrangeable on one or more outer portions of the hopper wagon body such that the cover is hinged to an exterior of the hopper wagon body adjacent the inlet, and the cover is rotatable in a substantially vertical plane between the closed position and the open position;

wherein the hinge mounts the cover in spaced relation above the inlet such that there is a gap space between the cover and the inlet when the cover is arranged in at least the closed position; and wherein the gap space is between a hinged edge region of the cover and an adjacent edge of the inlet.

2. A covering system according to claim 1, wherein the cover is configured to overhang the gap space so as to restrict the ingress of water.

3. A covering system according to claim 1, wherein the hinge comprises multiple hinge brackets that are arranged intermittently on the one or more outer portions of the hopper wagon body, adjacent the inlet.

4. A covering system according to claim 1, wherein the outer portion of the hopper wagon body is a cant rail.

5. A covering system according to claim 1, wherein the cover is a single leaf door.

6. A covering system according to claim 5, wherein the hinge is configured to hinge a side edge of the door to an outer portion of a sidewall of the hopper wagon body such that the door extends longitudinally, adjacent the side edge of the inlet and at least the length of the inlet, and the door is rotatable in a substantially vertical plane between the closed position and the open position.

7. A covering system according to claim 6, wherein the hinge is configured to hinge the side edge of the door in spaced relation above the inlet such that there is a gap space between the hinged edge side of the door and adjacent side edge of the inlet when the door is arranged in at least the closed position.

8. A covering system according to claim 1, wherein the cover is a double leaf door comprising a first door and a second door.

9. A covering system according to claim 8, wherein a first hinge is configured to hinge an outer side edge of the first door to an outer portion of a first sidewall of the hopper wagon body such that the first door extends longitudinally, adjacent a first side edge of the inlet and at least the length of the inlet and the first door is rotatable in a substantially vertical plane between a closed position and an open position, and a second hinge hinges an outer side edge of the second door to an outer portion of a second sidewall of the hopper wagon body such that the second door panel extends longitudinally, adjacent the second side edge of the inlet and at least the length of the inlet, and the second door is rotatable in a substantially vertical plane between a closed position and an open position.

10. A covering system according to claim 9, wherein the first hinge is configured to hinge the first door in spaced relation above the inlet such that there is a gap space between the hinged outer side edge of the first door and adjacent first side edge of the inlet when the first door is arranged in at least the closed position.

11. A covering system according to claim 9, wherein the second hinge is configured to hinge the second door in spaced relation above the inlet such that there is a gap space between the hinged outer side of the second door and adjacent second side edge of the inlet when the second door is arranged in at least the closed position.

12. A covering system according to claim 9, wherein the outer portion of the first sidewall of the hopper wagon body is a first cant rail and the outer portion of the second sidewall of the hopper wagon body is a second cant rail.

13. A covering system according to claim 9, wherein when the first door and second door are arranged in the closed position, the first door and second door are configured to extend across the inlet from the respective hinge at an incline relative to a horizontal plane such that inner edges of the first door and second door engage at an apex, thereby forming a closed cover with a cross-sectional profile of a triangle.

14. A covering system according to claim 9, further comprising sealing means configured to form a seal between the first door and second door when the inner edges of the first door and second door engage.

15. A covering system according to claim 8 wherein, when both the first door and second door are rotated to the closed position, the first door and second door are configured to extend across the inlet from the respective hinge such that corresponding inner edges of the first door and second door engage, thereby forming a closed cover.

16. A hopper wagon comprising:

a hopper wagon body for storing bulk commodities therein;

an inlet through which bulk commodities can be loaded into the hopper wagon;

a covering system for covering the inlet, whereby the covering system comprises a cover that closes the inlet when it is arranged in a closed position and opens the inlet when it is arranged in an open position and a hinge that mounts the cover on the hopper wagon body such that the cover is hinged to an outer portion the hopper wagon body, adjacent the inlet, and the cover is rotatable in a substantially vertical plane between the closed position and the open position;

wherein the hinge mounts the cover in spaced relation above the inlet such that there is a gap space between the cover and the inlet when the cover is arranged in at least the closed position; and wherein the gap space is between a hinged edge region of the cover and an adjacent edge of the inlet.

17. A hopper wagon according to claim 16, wherein the cover is configured to overhang the gap space so as to restrict the ingress of water.

* * * * *